US005870681A

United States Patent [19]

Myer

[11] Patent Number: 5,870,681

[45] **Date of Patent: *Feb. 9, 1999**

[54] SELF-STEERING ANTENNA ARRAY

[75] Inventor: Robert Evan Myer, Denville, N.J.

[73] Assignee: Lucent Technologies, Inc., Murray Hill, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 579,842

[22] Filed: Dec. 28, 1995

[51] Int. Cl.[6] ..... H04B 1/38; H04M 1/00

[52] U.S. Cl. ..... 455/582; 455/134; 455/135; 455/277.2; 343/895

[58] Field of Search ..... 343/895, 853; 342/368, 369, 374; 455/33.1, 33.3, 53.1, 54.1, 73, 132–135, 272, 277.1, 277.2, 67.1, 561, 562, 422, 424, 507

[56] References Cited

U.S. PATENT DOCUMENTS

| | | | |
|---|---|---|---|
| 3,988,737 | 10/1976 | Middlemark | 343/895 |
| 4,070,637 | 1/1978 | Assal et al. | 343/853 |
| 4,103,304 | 7/1978 | Burnham et al. | 343/853 |
| 4,680,591 | 7/1987 | Axford et al. | 343/853 |
| 4,746,867 | 5/1988 | Gunton | 343/895 |
| 4,772,890 | 9/1988 | Bowen et al. | 343/853 |
| 4,983,988 | 1/1991 | Franke | 343/853 |
| 5,041,842 | 8/1991 | Blaese | 343/895 |
| 5,095,535 | 3/1992 | Freeburg | 455/277.1 |
| 5,097,484 | 3/1992 | Akaiwa | 455/134 |
| 5,389,941 | 2/1995 | Yu | 343/853 |
| 5,603,089 | 2/1997 | Searle et al. | 455/507 |

*Primary Examiner*—Nguyen Vo

[57] ABSTRACT

A self-steering antenna apparatus for receiving and transmitting electromagnetic signals, includes a plurality of antennas for receiving and emitting electromagnetic signals and a plurality of receivers for processing the received electromagnetic signals. Each one of the plurality of receivers corresponds to a respective one of the plurality of antennas. Each receiver provides signal strength information indicating a signal strength of the electromagnetic signal received by the corresponding antenna. A comparator compares the signal strength information provided by each receiver, and determines which of the antennas is receiving the strongest electromagnetic signal. Switching circuitry switches the received electromagnetic signals and the signals to be emitted, based on the comparison performed by the comparator, the switching circuitry selecting one of the plurality of antennas to emit and receive the electromagnetic signals based on the comparison.

19 Claims, 9 Drawing Sheets

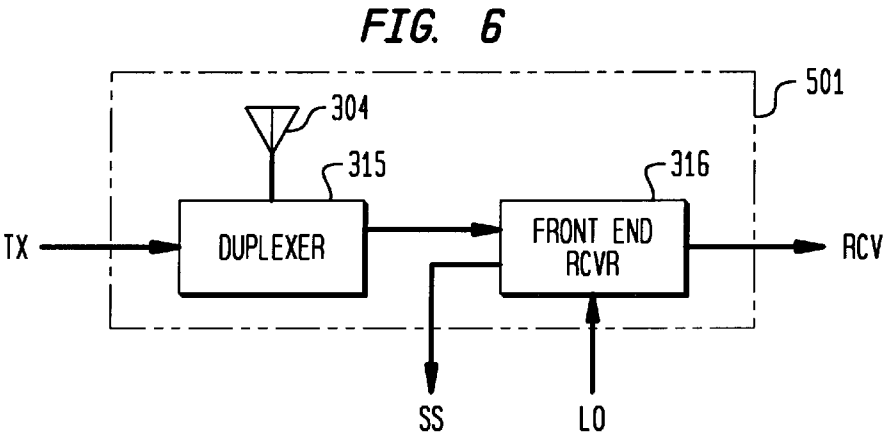
FIG. 6
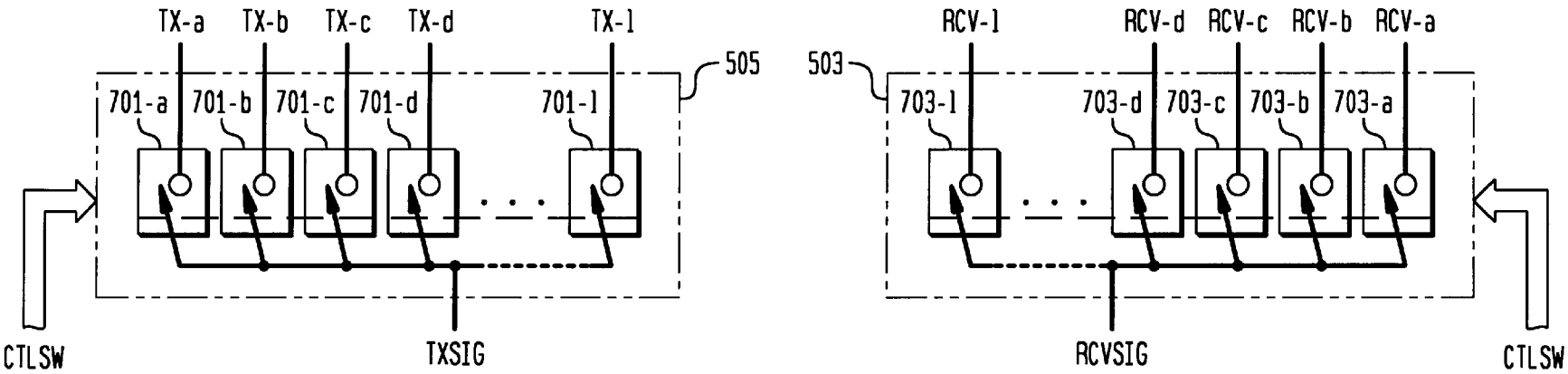
FIG. 7B
FIG. 7A

SELF-STEERING ANTENNA ARRAY

BACKGROUND OF THE INVENTION

1. Field of the Invention

The present invention relates to telecommunications in general, and more particularly, to a method and apparatus for a self-steering antenna array.

2. Description of the Related Art

FIG. 1 is a schematic diagram of a portion of a known type of telecommunications system, designated generally as 100. Telecommunications system 100 serves a number of wireless and wireline terminals situated within a geographic area. The infrastructure of telecommunications system 100 typically comprises wireless switching center 101 (WSC) interconnected with local switching offices 103 and 105, which can provide access for wireline terminals. Toll switching office 107 advantageously interconnects local switching offices 103 and 105 and wireless switching center 101 with other local switching offices (not shown) and other wireless switching centers (not shown).

Typically, wireless switching center 101 is connected to base stations 111–114 which are dispersed throughout a geographic area serviced by telecommunications system 100. Wireless switching center 101 is responsible for, among other things, routing, or "switching," calls between wireless terminals or, alternatively, between a wireless terminal and a wireline terminal accessible to wireless switching center 101 via local and/or long distance networks.

Telecommunications system 100 is preferably envisaged to carry signals that represent any type of information (e.g., audio, video, data, multimedia, etc.) and the wireless portion of telecommunications system 100 is envisaged to support one or more wireless access technologies (e.g., Frequency Division Multiple Access (FDMA), Time Division Multiple Access (TDMA), Code Division Multiple Access (CDMA)) in providing one or more services (e.g., cordless, cellular, PCS, wireless local loop, SMR/ESMR, two-way paging, etc.).

The geographic area serviced by telecommunications system 100 is typically partitioned into a number of spatially distinct regions called "cells." As depicted in FIG. 1, each cell is schematically represented by a hexagon; in practice, however, each cell usually has an irregular shape that depends on the topography of the terrain and other factors. Typically, each cell contains a base station. Each base station includes antennas and radios for communicating with wireless communications terminals (e.g., wireless terminals 131–135) situated within a cell. In addition, each base station includes equipment for communicating with wireless switching center 101.

Due to variations in the field strength of the radio signals being transmitted between the wireless terminals and base stations, radio channel fading often occurs. Diversity reception is typically performed at the base stations to reduce the impairment effects of radio channel fading.

As illustrated in FIG. 2, a typical base station for performing diversity reception includes multiple reception paths. That is, an uplink signal 201 from a wireless terminal is received by antennas 203 and 205 and amplified, demodulated, and decoded by radio receivers 207 and 209, respectively. The received signals are input to diversity processor 211 and, in a well-known manner, diversity processor 211 processes the signals to minimize the effects of radio channel fading. The information output by diversity processor 211 is input to processing circuitry 213 where it can be further processed and conveyed to wireless switching center 101. A downlink signal from wireless switching center 101 is received and processed by processing circuitry 213 coded and modulated by radio transmitter 215 and transmitted via antenna 217 as downlink signal 219.

Although diversity reception is effective in minimizing the effects of radio channel fading, implementing such a system is costly. For example, as described above, each uplink channel requires two antennas and two complete radio receivers as well as circuitry for implementing diversity processor 211. Diversity reception thus greatly increases the cost of implementing each base station.

SUMMARY OF THE INVENTION

The present disclosure is directed to a self-steering antenna apparatus for receiving and transmitting electromagnetic signals. The apparatus includes a plurality of antennas for receiving and emitting electromagnetic signals and a plurality of receivers for processing the received electromagnetic signals. Each one of the plurality of receivers corresponds to a respective one of the plurality of antennas. Each receiver provides signal strength information indicating a signal strength of the received electromagnetic signal. A comparator compares the signal strength information provided by each receiver to determine which one of the plurality of antennas is receiving the strongest signal. Based on the comparison performed by the comparator, switching circuitry switches the received electromagnetic signals and signals to be transmitted. The switching circuitry selects one of the antennas to transmit and receive the electromagnetic signals based on the comparison. According to one embodiment, each of the plurality of antennas are high gain, narrow bandwidth helical antenna elements arranged in a substantially circular pattern. Each of the antennas includes a duplexer, enabling it to receive and transmit electromagnetic signals.

BRIEF DESCRIPTION OF THE DRAWINGS

For a full understanding of the present disclosure, reference is made to an exemplary embodiment thereof, considered in conjunction with the accompanying figures in which like reference numerals designate like elements or features, for which:

FIG. 6 is a more detailed block diagram of the antenna/receivers shown in FIG. 5;

FIGS. 7A and 7B show, in more detail, the transmitting and receiving switches shown in FIG. 5;

DETAILED DESCRIPTION OF PREFERRED EMBODIMENTS

Figure 1:
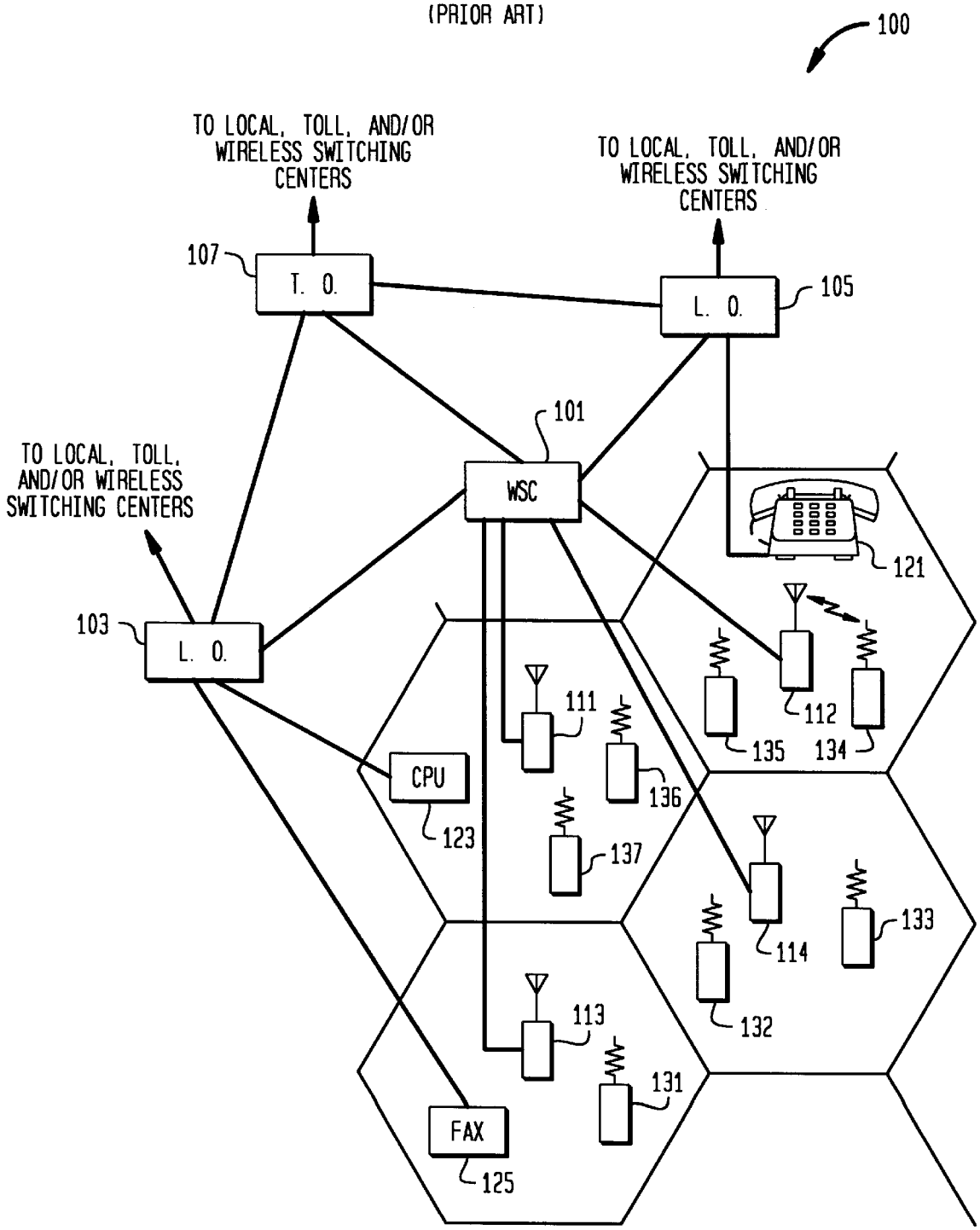
FIG. 1 (PRIOR ART)
FIG. 1 is a schematic diagram of a portion of a prior art wireless communications system.
Figure 2:
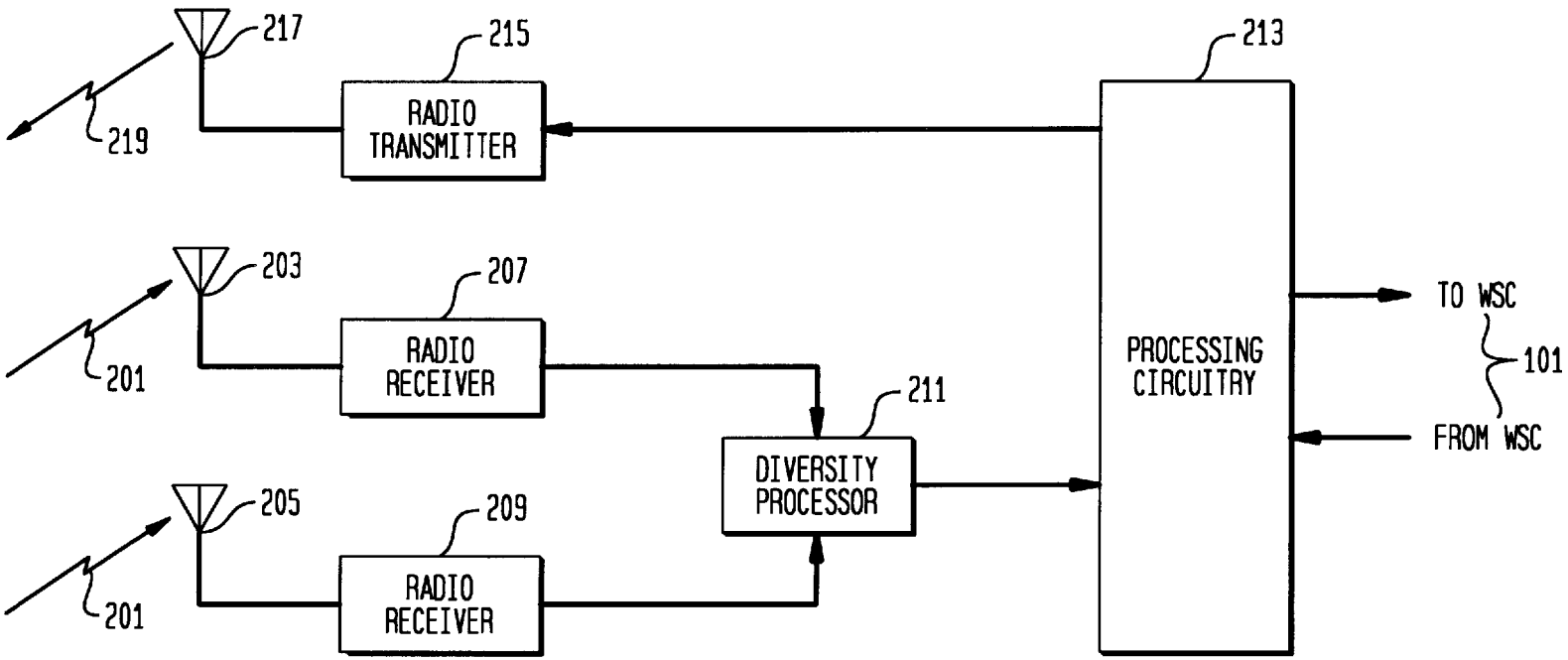
FIG. 2 (PRIOR ART)
FIG. 2 shows a block diagram of a portion of a typical prior art base station that performs diversity reception.
Figure 3:
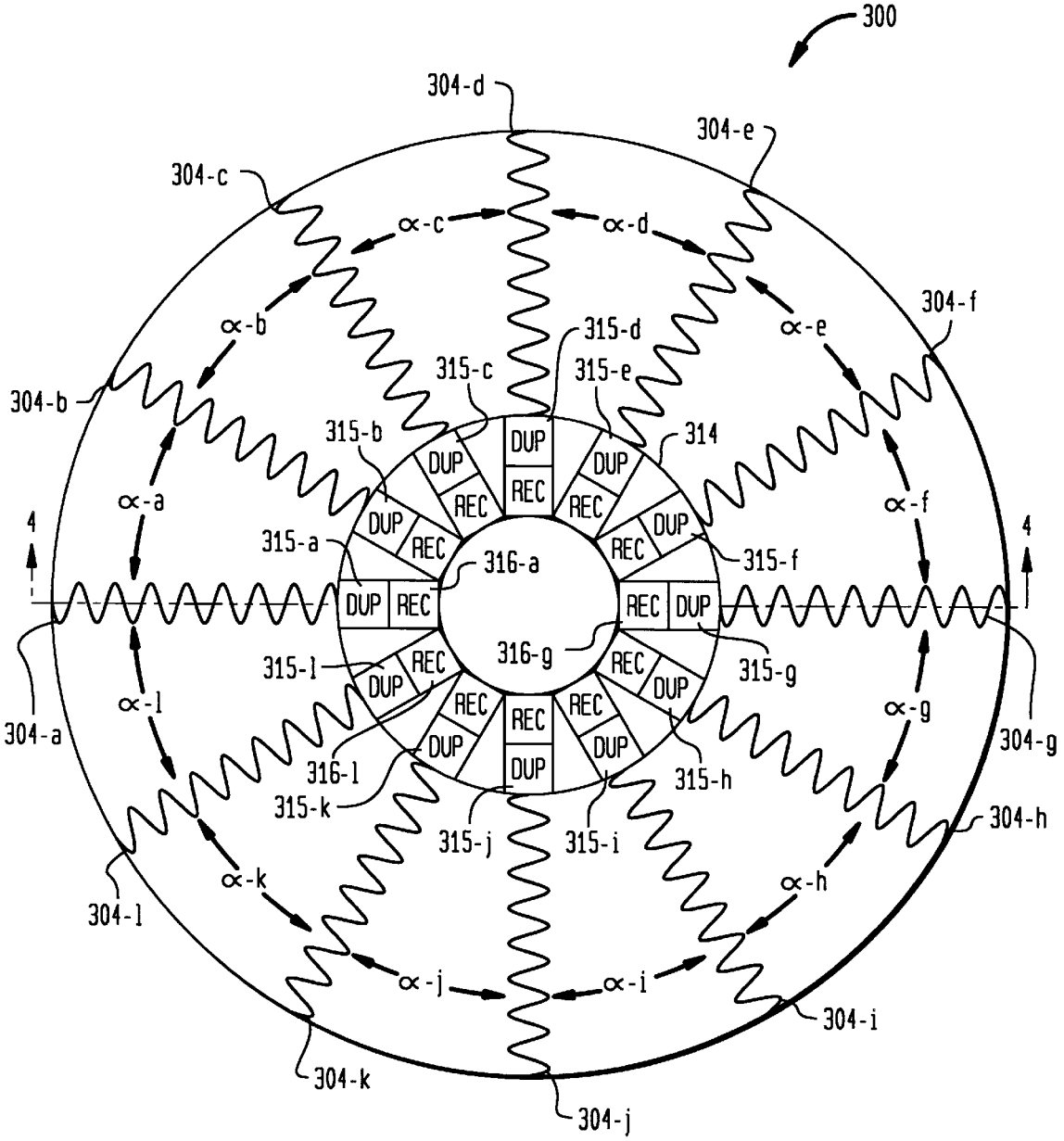
FIG. 3 shows a top view of an embodiment of an antenna array.

FIG. 3 depicts a self-steering circular antenna array referred to generally as array 300. A plurality of these arrays can be provided at a base station for communicating with wireless terminals within the geographic area covered by the base station. Array 300 comprises a plurality of antenna elements 304-a through 304-1, extending radially from core 314 as shown. Antenna elements 304-a through 304-1 are disposed at approximately 30° intervals around the circular array. To ensure adequate signal reception and transmission coverage in all directions, each antenna element has a 30° 3dB beamwidth. That is, as shown in FIG. 3 the angles α-a through α-1 between each antenna element 304-a through 304-1 are the same. By providing an appropriate number of evenly spaced antenna elements as shown in FIG. 3, array 300 is capable of efficiently transmitting and receiving electromagnetic signals a full 3600 about the array. Each antenna element 304-a through 304-1 is a helical antenna having a high gain and a narrow beamwidth. A greater or lesser number of antenna elements can be used depending on such factors as, for example, the physical terrain of the predefined area covered by the base station and the beamwidth of each of the antenna elements. Although depicted in FIG. 3 as a symmetrical arrangement of antenna elements, it should be appreciated that the antenna elements could, in the alternative, be arranged asymmetrically depending, for example, on the terrain. For example, angle α-a could be 30°, angle α-b could be 60°, α-c could be 30°, and angle α-d could be 45°, etc. Utilizing any number of antenna elements more than one, the angle between each antenna depends on the number of antenna elements being used. Core 314 includes circuitry for implementing antenna array 300. As shown, each antenna element 304-a through 304-1 has a corresponding duplexer 315-a through 315-1 and a corresponding receiver front end 316-a through 316-1. Core 314 also includes controller circuitry (not shown) and a set of transmitter and receiver switches (not shown). Each of these elements is described in more detail below.

Figure 4:
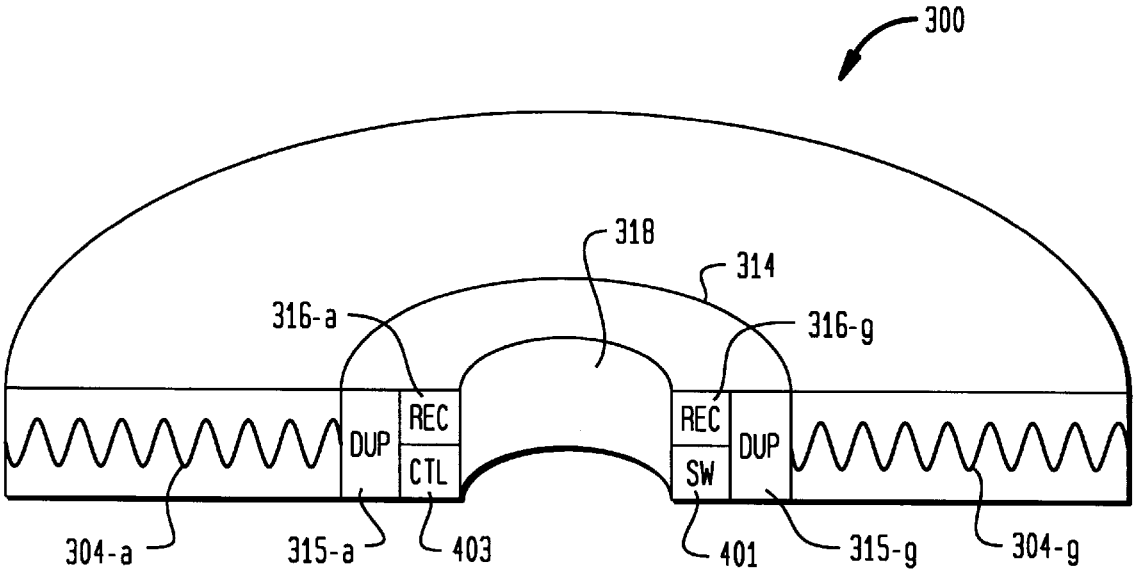
FIG. 4 is a cross-sectional view of the antenna elements taken along the line 4—4' of FIG. 1.

FIG. 4 is a cross-sectional view of antenna array 300 as shown in FIG. 3 taken along line 4—4'. As shown in FIG. 4, antenna array 300 forms a circular flat disk. As noted above, core 314 forming the center of the disk includes circuitry for implementing antenna array 300. This circuitry includes a duplexer 315 and a receiver front end 316 corresponding to each antenna element 304. For example, as shown in FIG. 4, antenna element 304-a has corresponding duplexer 315-a and receiver front end 316-a. Antenna element 304-g has corresponding duplexer 315-g and receiver front end 316-g. Core 314 of antenna array 300 also includes a set of receiver and transmitter switches 401 and control electronics 403 that are used to select which antenna element is to receive and transmit signals. As shown, antenna elements 304 extend radially from core 314. The center of core 314 forms channel 318 which allows wires or bundles of wires to be placed in the channel and connected with circuitry from the center of the disk.

Figure 5:
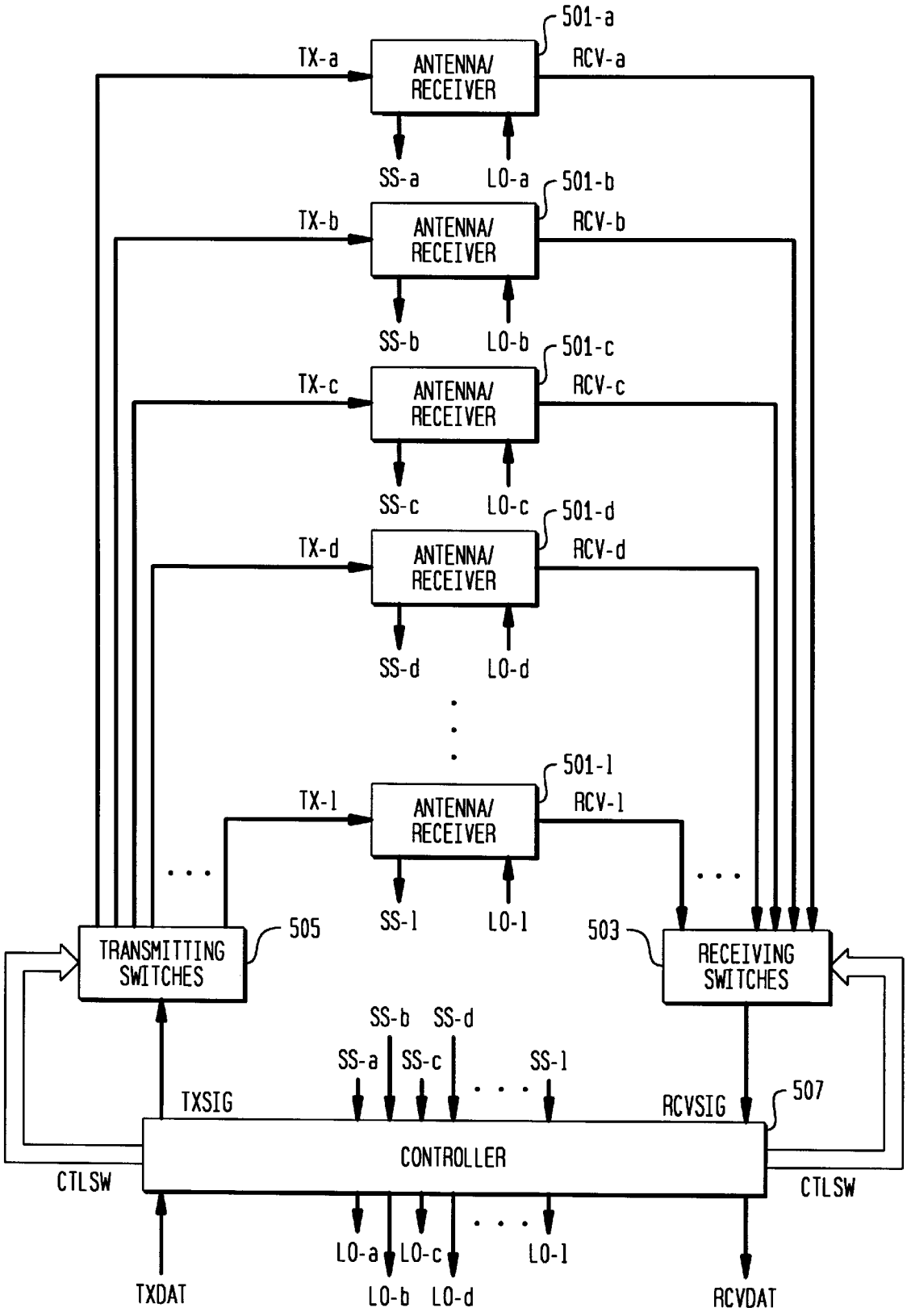
FIG. 5 is a block diagram of the electronic circuitry for implementing an embodiment of the antenna.
Figure 9:
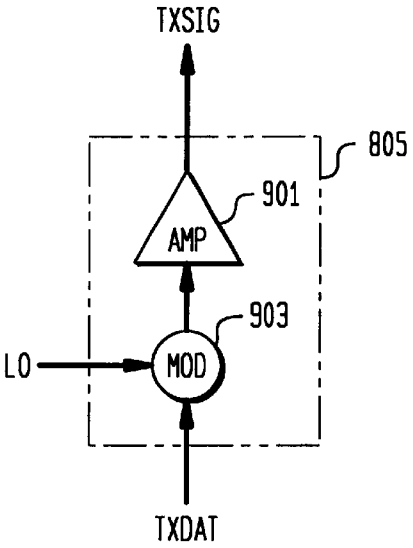
FIG. 9 is a more detailed block diagram of the modulator/amplifier shown in FIG. 8.

Circuitry for implementing the antenna array will now be described with reference to FIGS. 5–10. As shown in FIG. 5, signals RCV-a through RCV-1 are received by antenna/receivers 501-a through 501-1, respectively, and are routed to receiving switches 503. As shown in more detail in FIG. 6, signals received by antenna element 304 are directed, by duplexer 315, to receiver front end 316. Receiver front end 316 amplifies the received signal and demodulates it utilizing local oscillator signal LO and outputs received signal RCV. In addition, receiver front end 316 also determines the signal strength of the received signal and outputs a signal strength signal SS. For example, receiver front end 316 can determine the signal-to-noise ratio of the received signal and output corresponding information. In the alternative, receiver front end 316 can determine the power of the received signal in terms of absolute power in dBm and output corresponding information.

Transmit signal Tx is directed via duplexer 315 to antenna 304 where it is emitted. Returning to FIG. 5, signal strength signals SS-a through SS-1 from antenna/receivers 501-a through 501-1, respectively, are input to controller 507. Controller 507 compares the signal strength signals and determines which antenna element is receiving the strongest signal. Based on this determination, controller 507 controls receiving switches 503 and transmitting switches 505 accordingly. That is, utilizing switch control signals CTLSW, controller 507 selects the antenna receiving the strongest signal for both signal reception and signal transmission. For example, if controller 507 determines that antenna/receiver 501-a is receiving the strongest signal based on comparison of the signal strength signals, receiving switches 503 are set so that the received signal RCV-a from antenna/receiver 501-a is input to controller 507 as received signal RCVSIG. In addition, controller 507 selects the appropriate transmitting switch 505 so that transmit signal TXSIG is switched to the input of antenna/receiver 501-a as transmit signal Tx-a. Controller 507 also comprises circuitry for generating local oscillator signals LO-a through LO-1 used by antenna/receivers 501-a through 501-1, respectively, for demodulating received signals.

As shown in more detail in FIG. 7A, transmit signal TXSIG is commonly input to one side of each transmitting switch 701-a through 701-1. Control signals CTLSW from controller 507 close the switch corresponding to the antenna/receiver receiving the strongest signal so that transmitted signal TXSIG is directed to the appropriate antenna/receiver 501. Shown as a bus for convenience of illustration, control signals CTLSW can include twelve individual control signals for individually controlling each switch. As shown in FIG. 7B, received signals RCV-a through RCV-1 are provided at the inputs of receive switches 703-a through 703-1 from antenna/receivers 501-a through 501-1, respectively. Control signals CTLSW from controller 507 close the appropriate switch so that the received signal from antenna/receiver 501 receiving the strongest signal is provided at the output side of receiving switches 503 as received signal RCVSIG.

Figure 8:
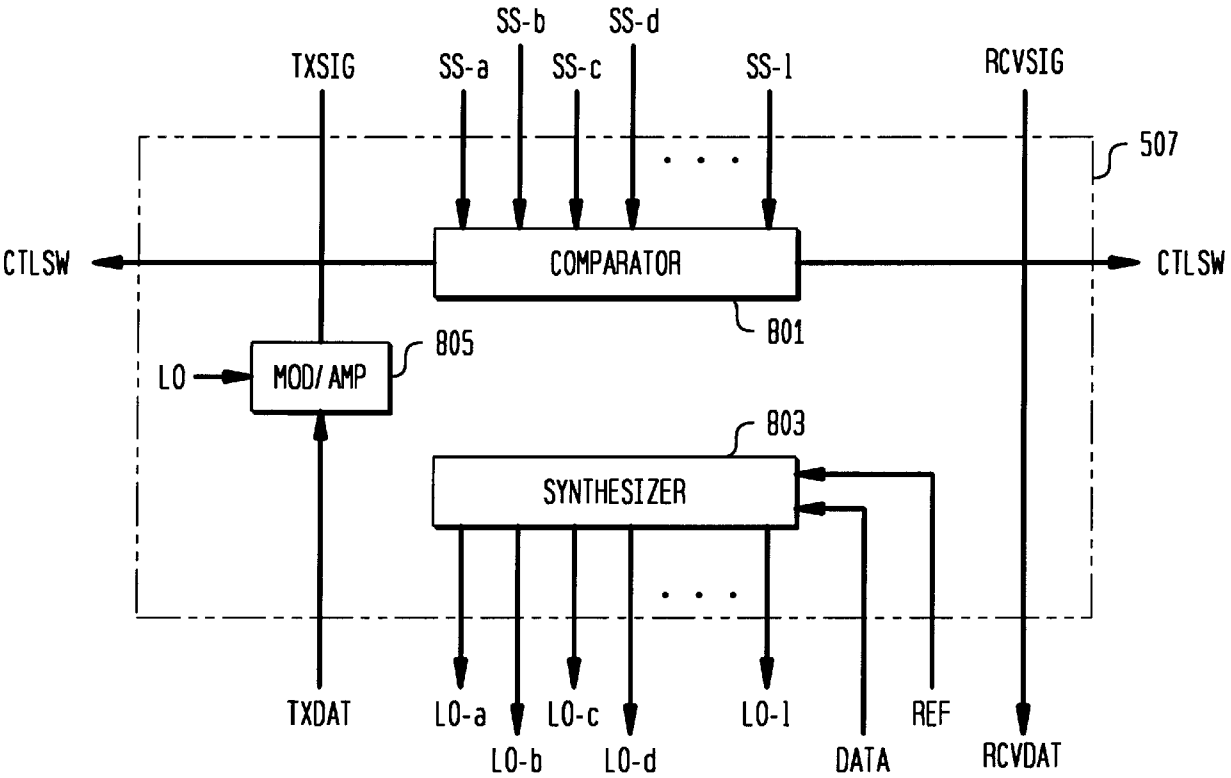
FIG. 8 is a more detailed block diagram of the controller shown in FIG. 5.

FIG. 8 is a more detailed block diagram of controller 507. Signal strength signals SS-a through SS-1 from antenna/receivers 501-a through 501-1, respectively, are input to comparator 801. Comparator 801 compares each of the signal strength signals and sets switch control signals CTLSW in order to select the appropriate receiving and transmitting switches. Controller 507 includes modulator/amplifier 805 that processes transmit data TXDAT. That is, as shown in more detail in FIG. 9, modulator 903 modulates transmit data TXDAT utilizing local oscillator signal LO. The modulated signal is then amplified by amplifier 901 and outputted as transmitted signal TXSIG.

Returning to FIG. 8, synthesizer 803 receives data and a reference signal REF from the basestation and generates local oscillator signals LO-a through LO-1 which are used by antenna/receivers 501-a through 501-1, respectively, for demodulating the received signals. Such synthesizers are well known in the art and will not be described in detail.

Figure 10:
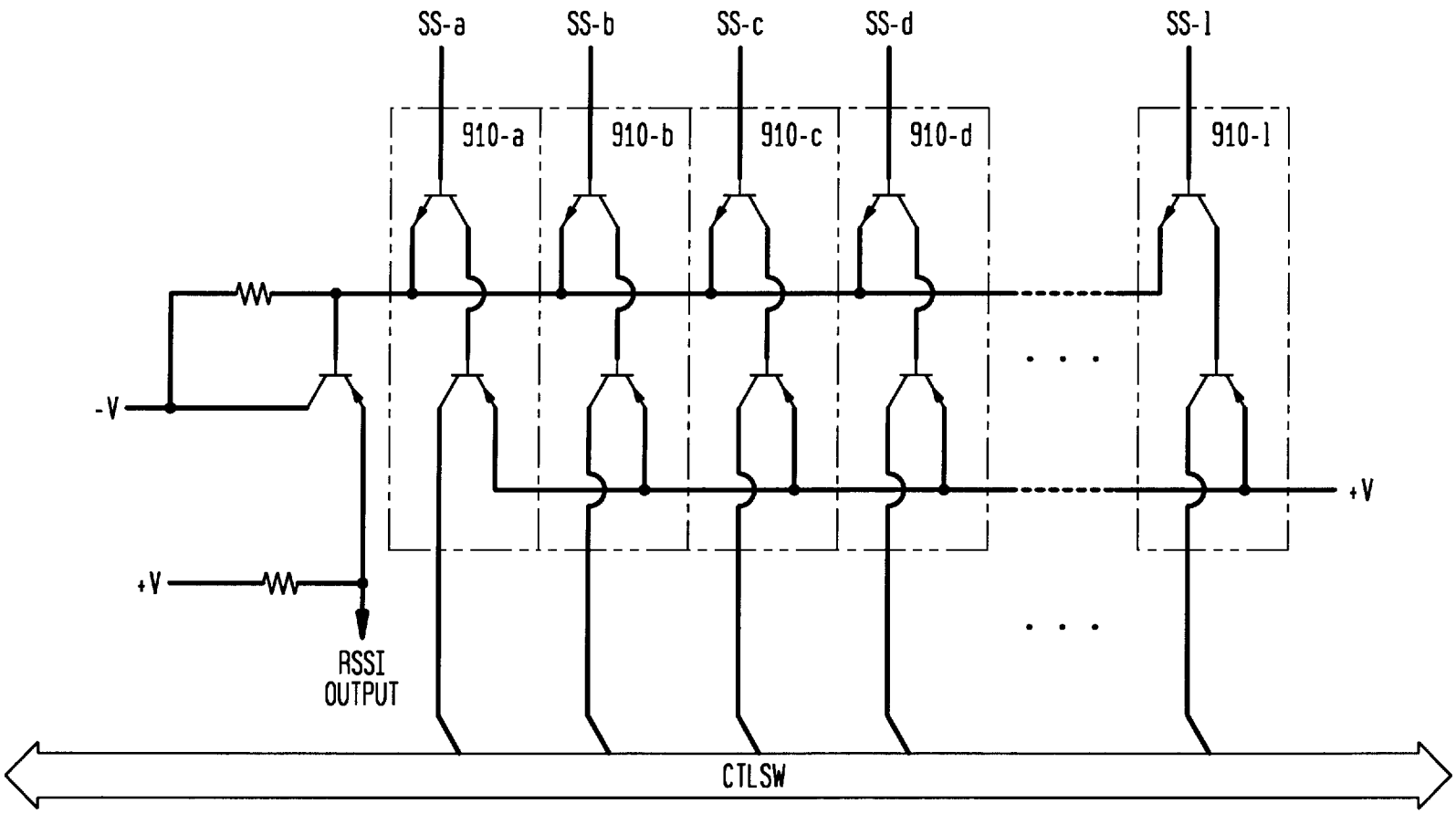
FIG. 10 is a detailed schematic drawing of the comparator shown in FIG. 8; and, FIG. 11 shows a plurality of stacked antenna arrays.

FIG. 10 illustrates comparator 801 in more detail. Comparator 801 includes a series of transistor groups 910-a through 910-1 forming a series of switches. These transistors form the selection processor portion of the comparator for selecting the antenna with the strongest signal and generating control switch signals CTLSW. By using the series of transistors, no software or computer processing is needed thereby minimizing cost and maintaining a simplified design.

Figure 11:
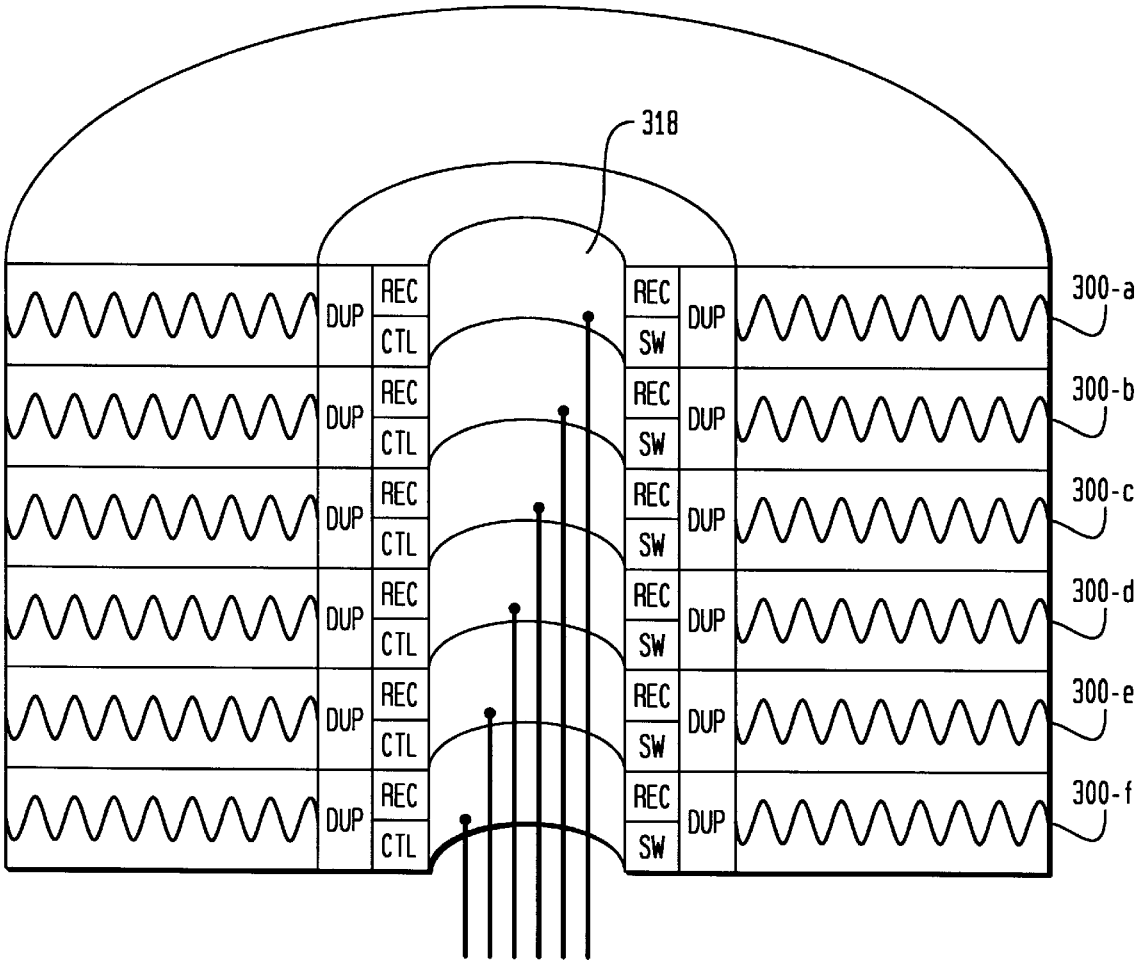

This antenna array provides a compact self steering antenna having advantageous R.F. efficiency. For example, since each radio has its own antenna, there is no combiner loss. Since only a single carrier amplifier is required and it is provided at the antenna, no intermodulation occurs and there is no cable loss. The use of narrow beamwidth, high gain antenna elements reduces the amount of R.F. transmission power required. In addition, as depicted in FIG. 11, a plurality of antenna arrays 300-a through 300-f can be stacked to form a compact and efficient antenna array system that can include many levels of redundancy. As shown, the very center of the stacked antenna arrays form a channel 318 so that wires or bundles of wires can be provided to each antenna array.

It will be understood that the embodiments described herein are merely exemplary and that one skilled in the art can make many modifications and variations to the disclosed embodiments without departing from the spirit and scope of the disclosure. For instance, while the embodiments disclosed above have been described in reference to wireless communications, the disclosure array may also be useful in television and radar applications. All such variations and modifications are intended to be included within the scope of the disclosure as defined by the appended claims.

What is claimed is:

1. A self-steering antenna apparatus for receiving and transmitting electromagnetic signals, comprising:

a plurality of helical antenna assemblies, each of said plurality of helical antenna assemblies comprising:

an axis generally oriented in the azimuthal plane and having a first end coupled to a respective control means for controlling said each of said plurality of helical antenna assemblies, said control means positioned between two additional control means along an arc to form a centralized channel having a longitudinal axis perpendicular to said axis, each of said plurality of antenna assemblies having a second end pointing radially outward from said centralized channel, the second ends of the antenna assemblies generally pointing in different azimuthal directions from one another, each helical antenna assembly operating independently from the other helical antenna assemblies and operative to receive and emit electromagnetic signals within a narrow beam pointing generally in the respective azimuthal direction; and a receiver for processing the received electromagnetic signals and for providing signal quality information of the electromagnetic signal received by each respective antenna assembly;

comparison circuitry for comparing the signal quality information provided by each receiver, and determining which of the antenna assemblies is receiving the highest quality electromagnetic signal; and switching circuitry for switching the received electromagnetic signals and the signals to be emitted, based on the comparison performed by the comparison circuitry, the switching circuitry selecting one of the plurality of antenna assemblies by transmitting a switching signal via said centralized channel to the selected antenna assembly to emit and receive the electromagnetic signals based on the comparison.

2. The apparatus according to claim 1, wherein said signal quality information comprises signal strength information, and said comparison circuitry determines which of the antenna assemblies is receiving the strongest electromagnetic signal.

3. The apparatus according to claim 1, wherein said plurality of antenna assemblies are arranged in a substantially circular pattern.

4. The apparatus according to claim 3, wherein said plurality of antenna assemblies are arranged in the substantially circular pattern as a substantially flat disk.

5. The apparatus according to claim 4, wherein said antenna assemblies are provided in a stacked array such that said plurality of antenna assemblies arranged as a substantially flat disk are stacked on top of another plurality of antenna assemblies arranged as a substantially flat disk such that the centralized channel of each antenna apparatus align.

6. The apparatus according to claim 3, wherein a center of the circular pattern includes electronic circuitry including the receiver for each antenna assembly, the comparison circuitry and the switching circuitry.

7. The apparatus according to claim 1, wherein each of said plurality of antenna assemblies further comprises a duplexer, enabling each antenna assembly to receive and transmit the electromagnetic signals.

8. The apparatus according to claim 1, wherein said comparator includes a series of electronic switches for generating control signals for controlling the switching circuitry.

9. The apparatus according to claim 1, further comprising a transmitter for generating the signals to be emitted, the transmitter including a single carrier transmit amplifier.

10. The apparatus according to claim 1, wherein each receiver corresponds to a respective antenna of said plurality of antenna assemblies, wherein each said receiver provides signal quality information indicating signal quality of the electromagnetic signal received by the corresponding antenna.

11. The apparatus according to claim 1, wherein said signal quality information comprises signal to noise ratio of the electromagnetic signal.

12. The apparatus according to claim 1, wherein at least one of the helical antenna assemblies has a beamwidth different from other ones of the helical antenna assemblies.

13. A method for receiving and transmitting electromagnetic signals, comprising the steps of:

receiving an electromagnetic signal utilizing a plurality of antennas, each one of said plurality of antennas having an axis generally oriented in the azimuthal plane and having a first end coupled to a respective one of a plurality of control means for controlling said one of said plurality of antennas, said control means positioned between two additional control means along an arc to form a centralized channel having a longitudinal axis perpendicular to said axes of said plurality of antennas, each one of said plurality of antennas having a second end pointing radially outward from said centralized channel, each antenna operating independently from each other and each pointing in a different generally azimuthal direction and having a narrow antenna beam pointing generally in the respective azimuthal direction, wherein 3600 of azimuthal coverage is provided with all of the beams;

determining a signal strength of the electromagnetic signal received at each of the plurality of antennas;

comparing the determined signal strengths and determining which of the antennas is receiving the strongest signal; and switching the received electromagnetic signal and signals to be transmitted based on the comparison performed by said comparing step to select the one of said plurality of antennas receiving the strongest signal by transmitting a switching signal to the selected antenna via the centralized channel for receiving and transmitting the electromagnetic signals.

14. The method according to claim 13, further comprising the step of amplifying the electromagnetic signal to be transmit by the selected antenna.

15. The method according to claim 13, further comprising the step of duplexing between receiving and transmitting the electromagnetic signal utilizing the selected one of the plurality of antennas.

16. The method of claim 13 wherein said plurality of antennas comprises about 12 antennas, each having a beamwidth of about 30°.

17. A communication system having at least one self-steering antenna array, said self-steering antenna array comprising:

a plurality of antennas each having an axis generally oriented in the azimuthal plane and having a first end in a common centralized region forming a centralized channel and a second end pointing radially outward from said centralized channel, the second ends of the antennas generally pointing in different azimuthal directions from one another, each antenna operating independently from the other antennas and operative to receive and emit electromagnetic signals within a narrow beam pointing generally in the respective azimuthal direction;

at least one receiver for processing the received electromagnetic signals and for providing signal quality information of the electromagnetic signal received by each antenna;

comparison circuitry for comparing the signal quality information provided by each receiver, and determining which of the antennas is receiving the highest quality electromagnetic signal; and switching circuitry for switching the received electromagnetic signals and the signals to be emitted, based on the comparison performed by the comparison circuitry, the switching circuitry selecting one of the plurality of antennas by transmitting a switching signal to the selected antenna via said centralized channel to emit and receive the electromagnetic signals based on the comparisons wherein said antenna array is in the form of a circular flat disk and configured for stacking thereon at least one antenna array such that the centralized channel of said antenna array and said at least one antenna array align.

18. The communication system of claim 17 wherein each said antenna is a helical antenna, and said plurality of antennas comprise about 12 helical antennas, each having a beamwidth of about 30°.

19. A self-steering antenna apparatus for receiving and transmitting electromagnetic signals, comprising:

a plurality of helical antenna assemblies arranged in a substantially circular pattern as a substantially flat disk, each of said plurality of helical antenna assemblies comprising:

an axis generally oriented in the azimuthal plane and having a first end in a common centralized region forming a centralized channel and a second end pointing radially outward from said centralized channel, the second ends of the antenna assemblies generally pointing in different azimuthal directions from one another, each helical antenna assembly operating independently from the other helical antenna assemblies and operative to receive and emit electromagnetic signals within a narrow beam pointing generally in the respective azimuthal direction; and a receiver for processing the received electromagnetic signals and for providing signal quality information of the electromagnetic signal received by each respective antenna assembly;

comparison circuitry for comparing the signal quality information provided by each receiver, and determining which of the antenna assemblies is receiving the highest quality electromagnetic signal; and switching circuitry for switching the received electromagnetic signals and the signals to be emitted, based on the comparison performed by the comparison circuitry, the switching circuitry selecting one of the plurality of antenna assemblies by transmitting a switching signal via said centralized channel to the selected antenna assembly to emit and receive the electromagnetic signals based on the comparison;

wherein said antenna assemblies are provided in a stacked array such that said plurality of antenna assemblies arranged as a substantially flat disk are stacked on top of another plurality of antenna assemblies arranged as a substantially flat disk such that the centralized channel of each antenna apparatus align.

* * * * *